US007270491B2

(12) United States Patent
Oda et al.

(10) Patent No.: US 7,270,491 B2
(45) Date of Patent: Sep. 18, 2007

(54) CODE LABEL PRINTER, METHOD THEREOF AND READOUTED PRINTED-CODE VERIFYING SYSTEM

(75) Inventors: Shuji Oda, Tokyo (JP); Tsutomu Noshiroya, Tokyo (JP)

(73) Assignee: Lintec Corporation, Tokyo (JP)

( * ) Notice: Subject to any disclaimer, the term of this patent is extended or adjusted under 35 U.S.C. 154(b) by 0 days.

(21) Appl. No.: 11/256,875

(22) Filed: Oct. 24, 2005

(65) Prior Publication Data

US 2006/0088353 A1 Apr. 27, 2006

(30) Foreign Application Priority Data

Oct. 25, 2004 (JP) ..... 2004-309990
Oct. 26, 2004 (JP) ..... 2004-310789

(51) Int. Cl.
*B41J 11/44* (2006.01)

(52) U.S. Cl. ..... 400/76; 101/288; 156/64

(58) Field of Classification Search ..... 400/76, 400/611, 120.1; 347/218, 2, 4; 156/582–584, 156/384, 360, 64, 361, 387, 517, 250, 277; 101/288, 227; 53/135.2, 135, 411, 155; 700/225; 382/124
See application file for complete search history.

(56) References Cited

U.S. PATENT DOCUMENTS 5,229,587 A * 7/1993 Kimura et al. ..... 235/432
5,425,823 A * 6/1995 Woodside, III ..... 156/64
5,771,657 A * 6/1998 Lasher et al. ..... 53/55
5,912,979 A * 6/1999 Gavrilos ..... 382/101
6,296,342 B1 * 10/2001 Oikawa ..... 347/21
6,529,220 B1 * 3/2003 Matsumoto ..... 346/140.1
6,564,121 B1 * 5/2003 Wallace et al. ..... 700/231
6,892,512 B2 * 5/2005 Rice et al. ..... 53/445
6,910,820 B2 * 6/2005 Baker et al. ..... 400/611
2001/0032138 A1 * 10/2001 Janiak et al. ..... 705/19
2003/0192639 A1 * 10/2003 Mitchell et al. ..... 156/250
2004/0005080 A1 * 1/2004 Hayduchok ..... 382/101
2004/0123564 A1 * 7/2004 McErlean et al. ..... 53/411

* cited by examiner

*Primary Examiner*—Ren Yan
(74) *Attorney, Agent, or Firm*—Norris McLaughlin & Marcus PA

(57) ABSTRACT

A code label printer is provided for producing code labels reliable to use in the market, the label printer checking a code such as a barcode printed on a label which is affixed on a product. In a code label printer 2, print barcode data D1 transmitted from a host computer 3 is received by a microcomputer board 7, a print engine 8 prints a barcode on a label in accordance with the received print barcode data D1, and a label affixing apparatus 9 affixes the barcode-printed label to a product on a conveying apparatus 6. Thereafter, a barcode reader 10 reads out barcode data D2 from the code printed on the label affixed to the product 5 on the conveying apparatus 6, and the readout barcode data D2 and the print barcode data D1 are collated, for attaining a result whether the barcode is correctly read out or not, in the microcomputer board 7.

10 Claims, 3 Drawing Sheets

CODE LABEL PRINTER, METHOD THEREOF AND READOUTED PRINTED-CODE VERIFYING SYSTEM

BACKGROUND OF THE INVENTION

1. Field of the Invention

The present invention relates to a code label printer for printing a code such as a barcode on a label, its control method and readout printed-code verifying system.

2. Description of the Related Art

A prior code label printer is disclosed in JP Patent No. 2,633,726. In the case of the code label printer in JP Patent No. 2,633,726, a barcode is printed on a label (3), which is attached on a release liner (2), by a thermal printing head (6), and the barcode printed on the label (3) is read out by a scanner (21), which is set downstream from the thermal printing head (6) and the platen (4), for verifying whether the printed barcode is correctly printed or not. A code label (3) having correct-verified code is peeled off from the release liner (2) and used as a good product, and a code label (3) having incorrect-verified code is not peeled off, being sent to a release liner winder together with the release liner (2) (Refer to lines 31 to 41 at the left column on page 3 and FIG. 1 of JP Patent No. 2,633,726. The reference numerals in parentheses are corresponded to those in JP Patent No. 2,633,726. The same is applied hereafter.)

However, according to the above conventional code label printer, a barcode printed on the label (3) is verified while the label (3) is still attached on the release liner (2) before the label (3) is peeled off from the release liner and affixed to a product. If any quality trouble such as wrinkles and bubbles would occur on the good code label (3) having correct-verified code during affixing operation to a product, after peeled off from the release liner (2), the label will change to failure to be read out correct code. It is impossible previously to check the quality trouble and eliminate it in the conventional code label printer. Thus, there is a problem that products with barcodes having some quality trouble may be circulated through markets and markets may be disarranged.

The present invention is made to solve the above problem. An object of the present invention is to provide a code label printer capable of checking whether a code such as a barcode is correctly printed on a code label and is the code label correctly affixed on a product. Another object of the present invention is to provide a code label printer capable of circulation of the products having accurate-readable code through markets. Another object of the present invention is to provide a control method for the code label printer. Another object of the present invention is to provide readout printed-code verifying system available for the code label printer.

SUMMARY OF THE INVENTION

To achieve the above objects, a code label printer of the present invention comprises receiving means for receiving print code data transmitted from a host computer, storing means for storing the code data received by the receiving means, printing means for printing a code on a label in accordance with the code data received by the receiving means, affixing means for affixing the code-printed label to a product on a conveying apparatus, a code reader for reading out a code data from the code printed on a code-printed label which is affixed to a product on the conveying apparatus, and collating means for collating the readout code data with the print code data stored in the storing means.

The above "code" includes a bar code, two-dimensional code, and code functioning similarly to the bar code and two-dimensional code. The above "code reader" is assumed as a code reader properly adopted in accordance with the code. For example, a bar code reader is adopted in the case of a bar code and a two-dimensional code reader is adopted in the case of a two-dimensional code.

A code label printer of the present invention comprises receiving means for receiving print barcode data transmitted from a host computer, storing means for storing the barcode data received by the receiving means, printing means for printing a barcode on a label in accordance with the barcode data received by the receiving means, affixing means for affixing the barcode-printed label to a product on a conveying apparatus, a barcode reader for reading out a barcode data from the barcode printed on a barcode-printed label which is affixed to a product on the conveying apparatus and collating means for collating the readout barcode data with the print barcode data stored in the storing means.

The above code label printer of the present invention may further comprise transmitting means for transmitting the collation result attained by the collating means to the host computer and a conveying-apparatus control computer.

A code label printer control method of the present invention is a control method of a code label printer for printing a code on a label in accordance with the print code data transmitted from a host computer. The code label printer has a microcomputer board, a controller, a print engine, a label affixing apparatus, and a code reader. The control method of a code label printer comprises step of storing the print code data transmitted from the host computer in the storing means of the microcomputer board, step of printing a code on a label in accordance with the print code data transmitted from the host computer by the print engine when the controller outputs a code print instruction signal to the print engine, step of executing the processing for affixing the label-printed label to a product on a conveying apparatus by the label affixing apparatus when the controller outputs a label affix instruction signal to the label affixing apparatus, and the processing for outputting a label affix completion signal to the controller in completion of the affixing, step of outputting a code read instruction signal to the code reader by the controller when the label affix completion signal is input to the controller, step of reading out a code data from the code printed on a code-printed label which is affixed to the product by the code reader when the code read instruction signal is input to the code reader, and step of transmitting the readout code data by the code reader to the microcomputer board and collating the readout code data with the print code data stored in the storing means of the microcomputer board.

A code label printer control method of the present invention is a control method of a code label printer for printing a barcode on a label in accordance with the print barcode data transmitted from a host computer. The code label printer has a microcomputer board, a controller, a print engine, a label affixing apparatus, and a barcode reader. The control method of a code label printer comprises step of storing the print barcode data transmitted from the host computer in the storing means of the microcomputer board, step of printing a barcode on a label in accordance with the print barcode data transmitted from the host computer by the print engine when the controller outputs a barcode print instruction signal to the print engine, step of executing the processing for affixing the barcode-printed label to a product on a conveying apparatus by the label affixing apparatus when the controller outputs a label affix instruction signal to the label affixing apparatus, and the processing for outputting a label affix completion signal to the controller in completion of the affixing, step of outputting a barcode read instruction signal to the barcode reader by the controller when the label affix completion signal is input to the controller, step of reading out a barcode data from the code printed on a barcode-printed label which is affixed to the product by the barcode reader when the barcode read instruction signal is input to the barcode reader, and step of transmitting the readout barcode data to the microcomputer board and collating the readout barcode data with the print barcode data stored in the storing means of the microcomputer board.

In the above code label printer control method of the present invention, the collation result may further be transmitted to the host computer and a conveying-apparatus control computer.

A readout printed-code verifying system of the present invention is provided with a code label printer, a host computer, and a conveying-apparatus control computer. The code label printer has receiving means for receiving print code data transmitted from the host computer, storing means for storing the print code data received by the receiving means, printing means for printing a code on a label in accordance with the print code data received by the receiving means, affixing means for affixing the code-printed label to a product on the conveying apparatus, a code reader for reading out a code data from the code, printed by the printing means, on the code-printed label which is affixed to a product on the conveying apparatus, collating means for collating the code data read by the code reader with the print code data stored in the storing means, and transmitting means for transmitting a collation result by the collating means to the host computer and a conveying-apparatus control computer. The host computer generates collation management data in accordance with the collation result. The conveying-apparatus control computer sorts products into a product to which a defective label regarded as improper collation is affixed and a product to which a label regarded as proper collation is affixed, by controlling a sorting unit of the conveying apparatus in accordance with the collation result.

A readout printed-code verifying system of the present invention is provided with a code label printer, a host computer, and a conveying-apparatus control computer. The code label printer has receiving means for receiving print barcode data transmitted from the host computer, storing means for storing the print barcode data received by the receiving means, printing means for printing a barcode on a label in accordance with the print barcode data received by the receiving means, affixing means for affixing the barcode-printed label to a product on the conveying apparatus, a barcode reader for reading out a barcode data from the code, printed by the printing means, on the code-printed label which is affixed to a product on the conveying apparatus, collating means for collating the barcode data read by the barcode reader with the print barcode data stored in the storing means, and transmitting means for transmitting a collation result by the collating means to the host computer and a control computer of the conveying apparatus. The host computer generates collation management data in accordance with the collation result. The conveying-apparatus control computer controls a sorting unit of the conveying apparatus in accordance with the collation result to divide products into a product to which a defective label regarded as improper collation is affixed and a product to which a label regarded as proper collation is affixed.

In the case of the above code label printer of the present invention, a code-printed label is affixed to a product on a conveying apparatus, a code is read from the code-printed label affixed to the product, and the read code data is collated with the print code data transmitted from a host computer. The same is applied to the above code label printer control method of the present invention and the readout printed-code verifying system of the present invention.

As described above, in the case of the present invention, a code-printed label is affixed to a product on a conveying apparatus and then, a code is read from the code-printed label affixed to the product, and the read code data is collated with the print code data transmitted from a host computer. Therefore, not only when a code cannot be accurately read from the label because the printed state of a code on a release liner is not preferable but also when a code cannot be accurately read from the label because the state after affixing the label is not preferable, a collation result of improper collation is obtained. Therefore, it is possible to effectively prevent products to which labels whose codes may be erroneously read are attached from getting into circulation through markets.

Moreover, according to the present invention, because collation between codes is performed in a code label printer, a computer dedicated to collation for performing collation or a program dedicated to collation to be built in the computer is not necessary and it is also possible to reduce the equipment introduction cost only by the above fact.

DETAILED DESCRIPTION OF THE PREFERRED EMBODIMENTS

A preferred embodiment of the present invention is described below in detail by referring to the accompanying drawings.

Figure 1:
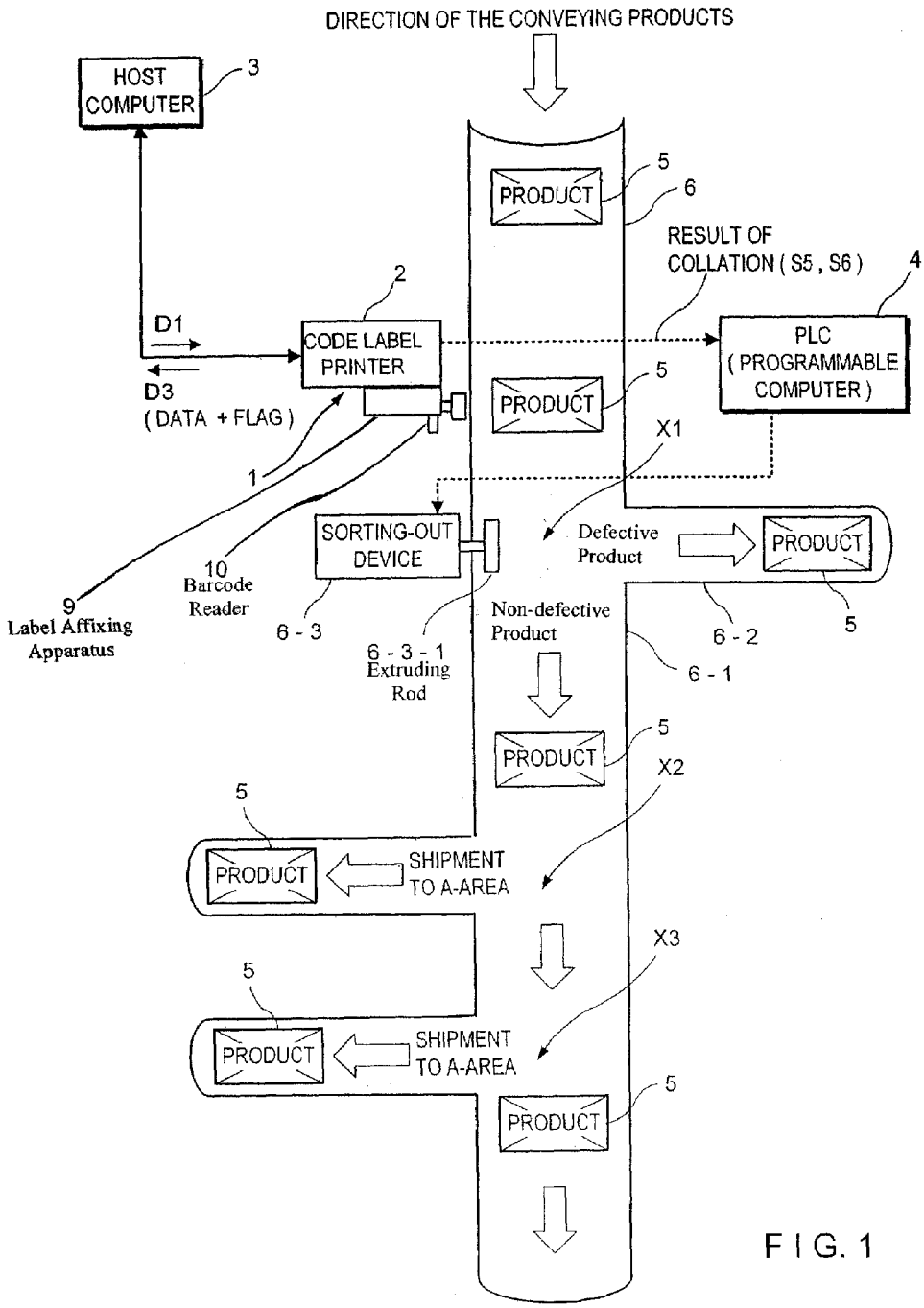
FIG. 1 is a top view of a readout printed-code verifying system using a code label printer of the present invention.
Figure 2:
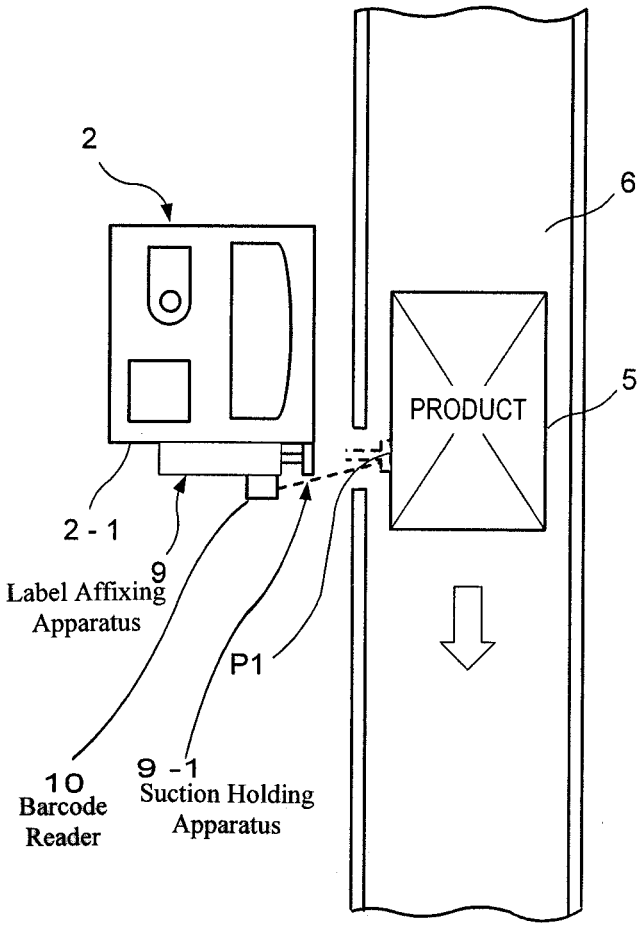
FIG. 2 is an enlarged top view of the readout printed-code verifying system in FIG. 1.
Figure 3:
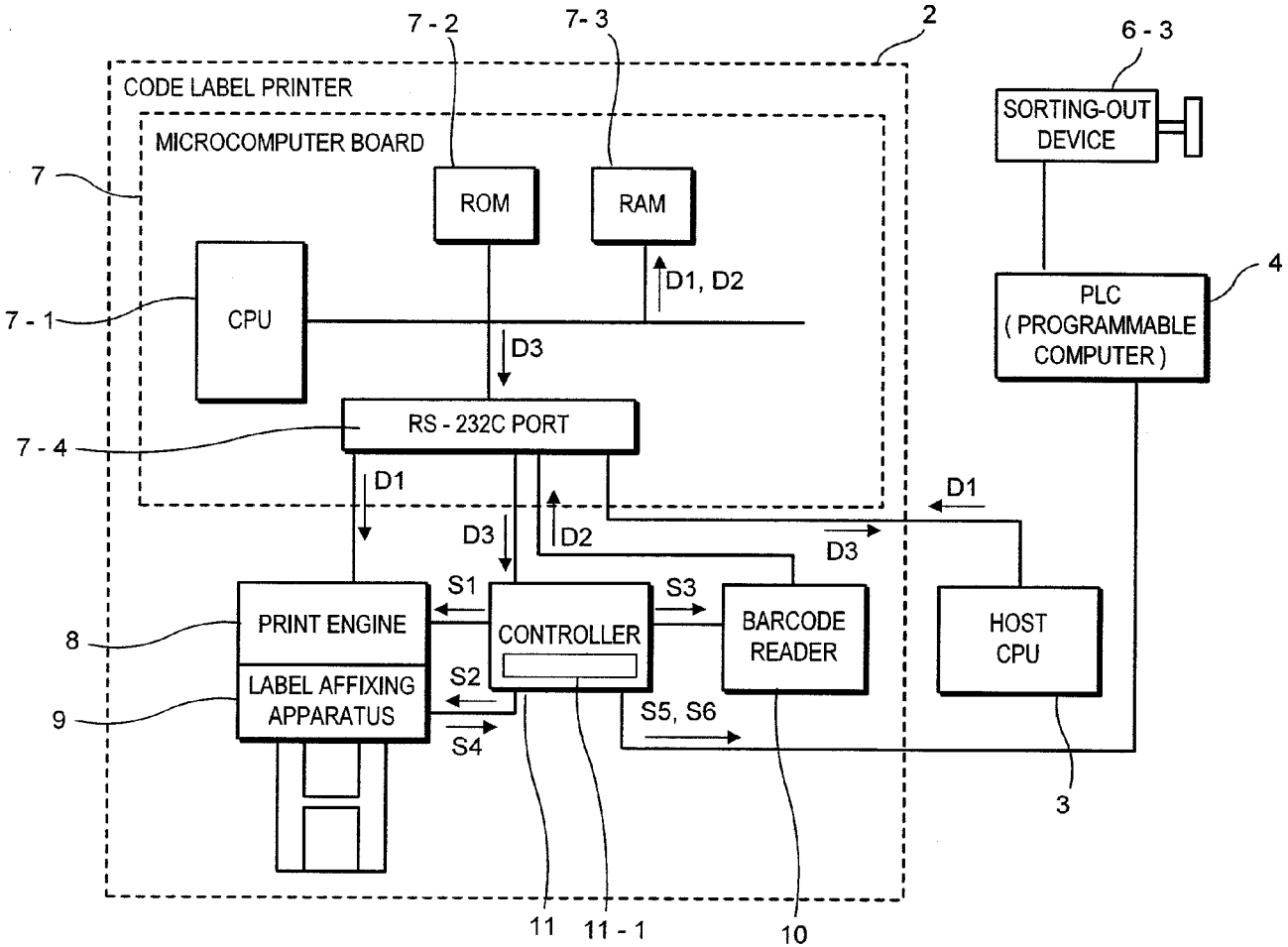
FIG. 3 is a block diagram of a code label printer used for the system in FIG. 1.

FIG. 1 is a top view of a readout printed-code verifying system using a code label printer of the present invention, FIG. 2 is an enlarged top view of the readout printed-code verifying system in FIG. 1, and FIG. 3 is a block diagram of a code label printer used for the system in FIG. 1.

The readout printed-code verifying system 1 in FIG. 1 provides with a code label printer 2, host computer 3, and PLC (programmable computer) 4 serving as a conveying-apparatus control computer.

In the case of the system 1, the code label printer 2 is set to a side of a conveying apparatus 6 for conveying a product 5 to be shipped to perform a series of processings from printing of a barcode on a label to affixing of a label to the product 5 on the conveying apparatus 6 and collate barcodes. The host computer 3 performs transmission of print barcode data D1 to the code label printer 2 and various managements in accordance with a collation result by the code label printer 2. The PLC 4 performs various controls of the conveying apparatus 6 in accordance with the collation result by the code label printer 2.

As shown in FIG. 3, the code label printer 2 is provided with a microcomputer board 7, a print engine 8, a label affixing apparatus 9, a barcode reader 10, and a controller 11.

The microcomputer board 7 includes a CPU 7-1, a ROM 7-2, and a RAM 7-3, and a plurality of RS232C ports 7-4 serving as communication ports. The microcomputer board 7 receives print barcode data D1 from the host computer 3 through the RS232C ports 7-4. Then, the print barcode data D1 received by the microcomputer board 7 is stored in storing means mounted on the microcomputer board 7, specifically in the RAM 7-3. Moreover, the print barcode data D1 received by the microcomputer board 7 is transferred to the print engine 8 through the RS232C port 7-4.

The print engine 8 has printing means for printing a barcode and other necessary information on a label temporarily set on a release liner, mechanism for supplying the label to the printing means, and mechanism for removing the barcode-printed label from the release liner and supplying the label to the label affixing apparatus 9. Various printing types such as dot print type, ink jet type, and laser print type are applied to the printing means. Moreover, it is possible to apply a publicly known or widely known mechanism to a label removing mechanism or label supplying mechanism independently of its type.

As shown in FIG. 2, the label affixing apparatus 9 is integrally set to a side of an armored case 2-1 of the code label printer 2. The label affixing apparatus 9 is means for receiving a barcode-printed label from the print engine 8 and affixing the label to the product 5 on the conveying apparatus 6. As shown in FIG. 2, the label affixing apparatus 9 of this embodiment uses a system for suction and receiving a barcode-printed label supplied from the print engine 8 at the bottom side of an suction holding apparatus 9-1 and then, when the suction holding apparatus 9-1 contacts with the product 5 on the conveying apparatus 6, affixes the barcode-printed label to the product 5. However, it is also allowed to use a system other than the above.

As shown in FIG. 2, the barcode reader 10 is set to a place from which the affixing position P1 of the barcode-printed label by the label affixing apparatus 9 can be sufficiently seen and immediately after the label affixing apparatus 9 affixes the barcode-printed label to the product 5 on the conveying apparatus 6, a barcode is read from the barcode-printed label affixed to the product 5.

The controller 11 is means for controlling the print engine 8, label affixing apparatus 9, and barcode reader 10 and outputs an instruction for executing each processing to the print engine 8, label affixing apparatus 9, and barcode reader 10. Specifically, the controller 11 outputs a barcode print instruction signal S1 to the print engine 8 and a label affix instruction signal S2 to the label affixing apparatus 9, and a barcode read instruction signal S3 to the barcode reader 10. These three instruction signals are individually output to the sides for receiving the instructions (print engine, label affixing apparatus, and barcode reader) in order of a barcode printing instruction, label affix instruction, and barcode read instruction at predetermined timings. Moreover, the controller 11 also has an external input/output port 11-1 for inputting and outputting the data D3 for collation result between the barcode data D1 transmitted from a host computer 3, which will be described later, and the barcode data D2 read by the barcode reader 10.

When the barcode print instruction signal S1 is input, the print engine 8 prints a barcode on a label in accordance with the print barcode data D1 transferred from the microcomputer board 7, that is, the print barcode data D1 transmitted from the host computer 3 and removes the barcode-printed label from a release liner supplies the label to the label affixing apparatus 9.

Then, when the label affix instruction signal S2 is input, the label affixing apparatus 9 receives a barcode-printed label from the print engine 8 and affixes the received barcode-printed label to the product 5 on the conveying apparatus 6. In this case, the controller 11 waits for a label affix completion signal S4 to be input. When the affixing is completed, the label affixing apparatus 9 outputs the label affix completion signal S4 to the controller 11. Then, when the label affix completion signal S4 is input to the controller 11, the controller 11 outputs a barcode read instruction signal S3 to the barcode reader 10. Thereby, the barcode read instruction signal S3 is input to the barcode reader 10 and the barcode reader 10 starts the operation for reading a barcode from the barcode-printed label affixed to the product 5.

The readout barcode data D2 read by the barcode reader 10 is transmitted to the microcomputer board 7 and stored in the RAM 7-3 of the microcomputer board 7 through the RS232C port 7-4 of the microcomputer board 7. Moreover, the readout barcode data D2 read by the barcode reader 10 is separately stored in a storage area different from the area of the print barcode data D1 transmitted from the host computer 3. Therefore, the print barcode data D1 transmitted from the host computer 3 and the readout barcode data D2 read by the barcode reader 10 are stored in the RAM 7-3 of the microcomputer board 7 in coexistence.

Furthermore, when the above two data values D1 and D2 are stored in the RAM 7-3 of the microcomputer board 7, the microcomputer board 7 collates the two data values D1 and D2, that is, the original print barcode data D1 transmitted from the host computer 3 with the readout barcode data D2 actually read. This collation is performed when the CPU 7-1 of the microcomputer board 7 executes a collation program stored in the ROM 7-2 of the microcomputer board 7. This collation program reads the two data values D1 and D2 from the RAM 7-3 and compares and collates the both.

When the above two data values D1 and D2 coincide with each other, collation is proper.

However, in the case other than the above, collation is improper. For example, when the readout barcode data D2 and the original print barcode data D1 transmitted from the host computer do not coincide with each other because the printed state of a barcode is not preferable and the barcode is erroneously read, collation is improper. Moreover, when the affixed state of a label is not preferable and a barcode cannot be read, collation cannot be made because the readout barcode data D2 to be read is absent. Also in this case, collation is improper. However, in the case other than the above, collation is proper.

The collation result data D3 by the microcomputer board 7 is transmitted both to the host computer 3 and to the controller 11 through the RS232C port 7-4 of the microcomputer board 7, and also the collation result data D3 is output to the PLC 4 from the external input/output port 11-1 of the controller 11. In this case, the collation result data D3 is transmitted to the host computer 3 by adding a flag showing that collation is improper or proper to actually read barcode data as a collation result. Moreover, the collation result data D3 is output to the PLC 4 from the external input/output port 11-1 by outputting two types of signals (hereafter referred to as collation result signal S5 or S6) showing that collation is proper or improper in accordance with the flag in the collation result data D3.

The host computer 3 receives the collation result data D3 from the microcomputer board 7 to generate various collation management data values such as the number of proper or improper collations and collation date in accordance with the collation result data D3.

The conveying apparatus 6 is branched into a nondefective-product conveying, route 6-1 and a defective-product excluding route 6-2 at the downstream side of the code label printer 2 and a sorting-out device 6-3 controlled by the PLC 4 is set to a side of the conveying apparatus 6 at the branch point X1.

The PLC 4 controls the sorting-out device 6-3 of the conveying apparatus 6 in accordance with the collation result signals S5 and S6, and sorts and divides the products into proper-collated-label-affixed products and improper-collated-label-affixed products.

That is, when the collation result data D3 is transmitted to the controller 11 from the RS232C port 7-4 of the microcomputer board 7 of the code label printer 2 and collation result signal S5 (improper-collation signal) is output to the PLC 4 through the external input/output port 11-1 of the controller 11, the PLC 4 outputs a predetermined signal to the sorting-out device 6-3. The predetermined signal is a signal for excluding a product (improper collation) to which a defective label regarded as improper collation is affixed. When the signal is input to the sorting-out device 6-3 and an improper-collation product passes through the branch point X1, an extruding rod 6-3-1 of the sorting-out device 6-3 advances and extrudes the improper-collation product to the defective-product excluding route 6-2 of the conveying apparatus 6.

When the collation result data D3 is transmitted to the controller 11 from the RS232C port 7-4 of the microcomputer board 7 of the code label printer 2 and the collation result signal S6 (proper-collation signal) is output to the PLC 4 through the external input/output port 11-1 of the controller 11, the PLC 4 outputs a predetermined signal to the sorting-out device 6-3. In this case, the predetermined signal is a signal for sending a product (proper-collation product) to which a label regarded as proper collation is affixed to shipping-destination sorting positions X2 and X3 at the downstream side of the nondefective-product conveying route 6-1. When the signal is input to the sorting-out device 6-3, the extruding rod 6-3-1 of the sorting-out device 6-3 does not advance even if the proper-collation product passes through the branch point X1 and therefore, the proper-collation product directly moves to the nondefective-product conveying route 6-1 of the conveying apparatus 6.

Therefore, according to the readout printed-code verifying system described above, it is possible to check whether a barcode is correctly printed on a label at the code label printer 2 and prevent products whose barcodes may be erroneously read from circulating through markets because only proper-collation products are conveyed to shipping-destination sorting points X2 and X3 and improper-collation products are excluded through the branch route 6-2.

For the above embodiment, an example is described in which a barcode is printed on a label in accordance with print barcode data and the barcode printed on the label is read out by a barcode reader.

However, it may be adopted to print the data for a code other than a barcode such as the data for a two-dimensional code on a label and read the two-dimensional code printed on the label by a code reader. In this case, a two-dimensional code reader is applied as the code reader and "barcode" in the description is replaced to "two-dimensional code".

What is claimed is:

1. A code label printer comprising:

receiving means for receiving print code data transmitted from a host computer;

storing means for storing the code data received by the receiving means;

printing means for printing a code on a label in accordance with the code data received by the receiving means;

affixing means for affixing the label, on which the printing means has printed the code, to a product on a conveying apparatus;

a code reader, disposed adjacent to the affixing means so that the affixing position of the code-printed label on a product is within sight of the code reader, for reading out at the affixing position a code data from the code printed by the printing means on the code-printed label which is affixed to a product on the conveying apparatus; and collating means for collating the readout code data read out by the code reader with the print code data stored in the storing means, attaining a collation result therefrom.

2. The code label printer according to claim 1, further comprising:

transmitting means for transmitting the collation result attained by the collating means to the host computer and a conveying-apparatus control computer.

3. A code label printer comprising:

receiving means for receiving print barcode data transmitted from a host computer;

storing means for storing the barcode data received by the receiving means;

printing means for printing a barcode on a label in accordance with the barcode data received by the receiving means;

affixing means for affixing the label, on which the printing means has printed the barcode, to a product on a conveying apparatus;

a barcode reader, disposed adjacent to the affixing means so that the affixing position of the barcode-printed label on the product is within sight of the barcode reader, for reading out at the affixing position a barcode data from the barcode printed by the printing means on the barcode-printed label which is affixed to a product on the conveying apparatus; and collating means for collating the readout barcode data read by the barcode reader with the print barcode data stored in the storing means, attaining a collation result therefrom.

4. The code label printer according to claim 3, further comprising:

transmitting means for transmitting the collation result attained by the collating means to the host computer and a conveying-apparatus control computer.

5. A control method of a code label printer, the code label printer having a microcomputer board, a controller, a print engine, a label affixing apparatus, and a code reader, and printing a code on a label in accordance with print code data transmitted from a host computer, and the code reader being disposed adjacent to the affixing apparatus so that the affixing position of the code-printed label on a product is within sight of the code reader, comprising:

a step of storing the print code data in storing means of the microcomputer board;

a step of printing a code on a label by the print engine in accordance with the print code data transmitted from the host computer when the controller outputs a code print instruction signal to the print engine;

a step of executing the processing for affixing the code-printed label to a product on a conveying apparatus by the label affixing apparatus when the controller outputs a label affix instruction signal to the label affixing apparatus, and the processing for outputting a label affix completion signal to the controller in completion of the affixing;

a step of outputting a code read instruction signal to the code reader from the controller when the label affix completion signal is input to the controller;

a step of reading out, immediately after the label affixing execution at the affixing position, a code data from the code printed on a code-printed label which is affixed to the product by the code reader when the code read instruction signal is input to the code reader; and a step of transmitting the readout code data actually read out by the code reader to the microcomputer board and collating the readout code data with the print code data stored in the storing means of the microcomputer board, attaining a collation result from the collating.

6. The code label printer control method according to claim 5, wherein the collation result collated by the microcomputer board is transmitted to the host computer and a conveying-apparatus control computer.

7. A code label printer control method of a code label printer, the code label printer having a microcomputer board, a controller, a print engine, a label affixing apparatus, and a barcode reader, and printing a barcode on a label in accordance with print barcode data transmitted from a host computer, and the code reader being disposed adjacent to the affixing apparatus so that the affixing position of the code-printed label on a product is within sight of the code reader, comprising:

a step of storing the print barcode data in storing means of the microcomputer board;

a step of printing a barcode on a label in accordance with the print barcode data transmitted from the host computer by the print engine when the controller outputs a barcode print instruction signal to the print engine;

a step of executing the processing for affixing the barcode-printed label to a product on a conveying apparatus by the label affixing apparatus when the controller outputs a label affix instruction signal to the label affixing apparatus, and the processing for outputting a label affix completion signal to the controller in completion of the affixing;

a step of outputting a barcode read instruction signal to the barcode reader from the controller when the label affix completion signal is input to the controller;

a step of reading out, immediately after the label affixing execution at the affixing position, a barcode data from the barcode printed on a barcode-printed label which is affixed to the product by the barcode reader when the barcode read instruction signal is input to the barcode reader; and a step of transmitting the readout barcode data actually read out by the barcode reader to the microcomputer board and collating the readout code data with the print barcode data stored in the storing means of the microcomputer board, attaining a collation result from the collating.

8. The code label printer control method according to claim 7, wherein the collation result collated by the microcomputer board is transmitted to the host computer and a conveying-apparatus control computer.

9. A readout printed-code verifying system comprising a code label printer, a host computer and a conveying-apparatus control computer; wherein the code label printer has receiving means for receiving print code data transmitted from the host computer, storing means for storing the print code data received by the receiving means, printing means for printing a code on a label in accordance with the print code data received by the receiving means, affixing means for affixing the code-printed label to a product on the conveying apparatus, a code reader, disposed adjacent to the affixing means so that the affixing position of the code-printed label on the product is within sight of the code reader, for reading out at the affixing position a code data from the code, printed by the printing means, on the code-printed label which is affixed to a product on the conveying apparatus, collating means for collating the readout code data read by the code reader with the print code data stored in the storing means, attaining a collation result from the collating and transmitting means for transmitting the collation result by the collating means to the host computer and a conveying-apparatus control computer;

the host computer generates collation management data in accordance with the collation result, and the conveying-apparatus control computer controls a sorting-out device of the code-labeled products on the conveying apparatus in accordance with the collation result transmitted to the conveying-apparatus control computer.

10. A readout printed-code verifying system comprising a code label printer, a host computer and a conveying-apparatus control computer; wherein the code label printer has receiving means for receiving print barcode data transmitted from the host computer, storing means for storing the print barcode data received by the receiving means, printing means for printing a barcode on a label in accordance with the print barcode data received by the receiving means, affixing means for affixing the barcode-printed label to a product on the conveying apparatus, a barcode reader, disposed adjacent to the affixing means so that the affixing position of the barcode-printed label on the product is within sight of the barcode reader, for reading out at the affixing position a barcode data from the code, printed by the printing means, on the code-printed label which is affixed to a product on the conveying apparatus, collating means for collating the readout barcode data read by the barcode reader with the print barcode data stored in the storing means, attaining a collation result from the collating, and transmitting means for transmitting the collation result by the collating means to the host computer and a conveying-apparatus control computer;

the host computer generates collation management data in accordance with the collation result, and the conveying-apparatus control computer controls a sorting-out device of the code-labeled products on the conveying apparatus in accordance with the collation result transmitted to the conveying-apparatus control computer.

* * * * *